US007533445B2

(12) United States Patent
Salice

(10) Patent No.: US 7,533,445 B2
(45) Date of Patent: May 19, 2009

(54) HINGE WITH SPRING FOR FURNITURE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/845,533

(22) Filed: May 12, 2004

(65) Prior Publication Data

US 2004/0226139 A1 Nov. 18, 2004

(30) Foreign Application Priority Data

May 14, 2003 (IT) ..... RM20030086 U

(51) Int. Cl.
*E05F 1/08* (2006.01)

(52) U.S. Cl. ..... 16/286

(58) Field of Classification Search ..... 16/236, 16/242, 245, 246, 272, 287, 288, 286, 366, 16/238

See application file for complete search history.

(56) References Cited

U.S. PATENT DOCUMENTS

| | | | | | |
|---|---|---|---|---|---|
| 3,744,086 | A * | 7/1973 | Salice et al. | ..... | 16/302 |
| 4,112,543 | A * | 9/1978 | Rock et al. | ..... | 16/307 |
| 4,114,237 | A * | 9/1978 | Grass | ..... | 16/294 |
| 4,449,269 | A * | 5/1984 | Sundermeier et al. | ..... | 16/50 |
| 4,502,182 | A * | 3/1985 | Lautenschlager et al. | ..... | 16/288 |
| 4,641,394 | A * | 2/1987 | Rock et al. | ..... | 16/302 |
| 4,654,930 | A * | 4/1987 | Lautenschlager et al. | ..... | 16/288 |
| 4,894,884 | A * | 1/1990 | Lautenschlager, Jr. | ..... | 16/278 |
| 5,008,977 | A * | 4/1991 | Lautenschlager et al. | ..... | 16/278 |
| 5,144,722 | A * | 9/1992 | Salice | ..... | 16/240 |
| 5,493,759 | A * | 2/1996 | Salice | ..... | 16/238 |
| 6,237,191 | B1 * | 5/2001 | Ferrari et al. | ..... | 16/335 |
| 6,401,298 | B1 * | 6/2002 | Lenz | ..... | 16/335 |
| 6,601,267 | B2 * | 8/2003 | Salice | ..... | 16/287 |
| 6,715,183 | B1 * | 4/2004 | Lautenschlager | ..... | 16/286 |

FOREIGN PATENT DOCUMENTS

| | | | |
|---|---|---|---|
| DE | 3513521 | A * | 11/1985 |
| DE | 3840244 | A1 * | 5/1990 |
| DE | 3840245 | A1 * | 5/1990 |
| DE | 3912630 | A * | 10/1990 |
| DE | 20012934 | U1 * | 12/2001 |
| DE | 10152699 | A1 * | 4/2003 |
| EP | 400501 | A * | 12/1990 |
| EP | 1048809 | A1 * | 11/2000 |

* cited by examiner

*Primary Examiner*—Chuck Y. Mah
(74) *Attorney, Agent, or Firm*—Abelman, Frayne & Schwab

(57) ABSTRACT

A furniture hinge includes an arm for fastening to a piece of furniture, and a part for fastening to a door, where the items are joined by two rockers to form an articulated quadrilateral that allows rotation, and a V-shaped spring, placed near an end of a rocker, with an arm of the spring resting on the arm and the second arm of the spring resting on a protrusion or cam of the rocker to create a lever arm that compresses the spring producing a moment in the opening or closing direction of the door, depending on the shape the protrusion found on the rocker.

13 Claims, 4 Drawing Sheets

HINGE WITH SPRING FOR FURNITURE

TECHNICAL FIELD

This invention relates to a hinge with spring for doors or, more in general, for furniture elements that can be opened and closed. More particularly, it relates to a hinge equipped with a spring that exerts a pushing force during closing or opening.

BACKGROUND ART

Pieces of furniture which include at least one internal storage space are often equipped with doors or leaves that open and close by rotating around a horizontal or vertical axis using a hinge mechanism. A very common system, which is widely used in the furniture industry, is provided with hinges for supporting the doors in the closed position that are hidden when the door of the piece of furniture is closed.

U.S. Pat. Nos.3,362,042 and 4,226,001, for example, describe these types of hinges in detail. The hinges described in these documents have several advantages that have determined their popularity and widespread use on the market. The described alternative versions use different types of springs in the hinge to produce a biasing force when the door to which they are attached is closed. Consequently, the doors on the piece of furniture close in a facilitated and very precise manner. Unfortunately, in these cases it is almost always necessary to exert an additional external force to open the door of the piece of furniture, which entails the availability of some type of handle. Sometimes, doors with handles or other outwardly visible gripping devices are not desirable. Therefore, a device with a spring that generates an opening moment on the door must be used to open the door. To accomplish this, the spring must be separate from the hinges, or highly complex hinges are required.

SUMMARY OF THE INVENTION

It is a main object of this invention to provide a hinge that is versatile and inexpensive in manufacture, using as many standard hinge parts as possible. This object is achieved by means of a hinge with spring in accordance with claim 1.

Thanks to its features, the hinge of the invention is versatile because it can be made in different versions suitable for different types of applications. Nearly all components that make up the hinge are kept in the same shape and by replacing only one part: a rocker, a hinge with a pushing force during closing can be transformed into a hinge with a pushing force during opening. The dependent claims describe preferred embodiments of the invention.

BRIEF DESCRIPTION OF THE DRAWINGS

These and other advantages and properties of the invention shall become apparent from the detailed description of preferred embodiments of a hinge, given by way of non-limiting examples and in conjunction with the following appended drawings.

DESCRIPTION OF THE INVENTION

Figure 1:
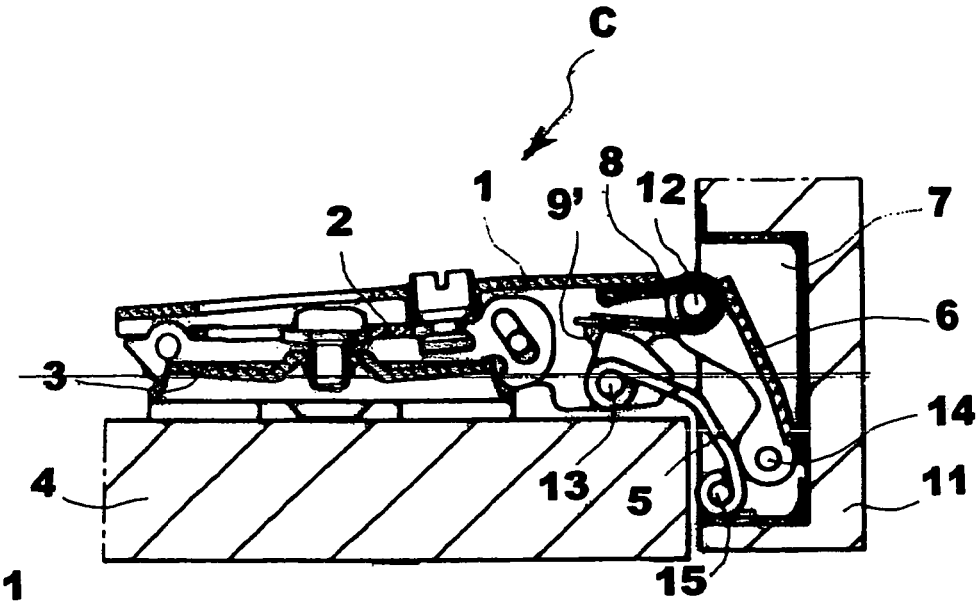
FIGS. 1, 2, 3 show a section of the hinge of the invention in three different opening positions of a door of a piece of furniture.

With reference to the above figures, what follows is a detailed description of preferred embodiments of a hinge, globally referred to with "C". The hinge comprises a fixed part, or arm (1), that can be attached to a base, or plate (3), integrally fixed to a supporting wall (4), which can be the side or any appropriate part of a piece of furniture. The hinge (C) comprises arm-fastening and adjusting parts so that the arm can be adjusted in the three orthogonal directions. A plate (2) is used to adjust the position of the hinge in the frontal and side directions with respect to the piece of furniture; whereas the means for adjusting the position of the hinge in the other orthogonal direction are not shown in detail in the Figures, since these are means known in the art.

Two rockers 5, 6 are provided; having a respective first end pivoting around two respective pins 12, 13 housed in holes in the side walls of the arm 1. The arm 1 is linked to a box element 7, fixed to a cavity made on the internal wall of the door 11 or of any other appropriate pivoting part of the piece of furniture. The two respective second extremities of the rockers 5, 6 are housed in other two respective pins 14, 15 having axes parallel to the first two pins 12, 13. The four pins 12, 13, 14, 15 form a four-bar linkage. A V-shaped spring 8 is placed around a pin 12 integral to the arm 1. One arm 8' of the spring rests on the back of the arm 1; the second arm 8" rests on a protrusion 9 of the rocker 5 housed in the other pin integral with the arm 1, so as to form a lever arm.

The position and the shape of the protrusion 9', 9", 9'" is chosen so as to produce a moment on the rocker 5 during the door-opening or closing pivoting. This reaction to this moment is sufficient to push the pivoting part 7 toward the open position—this version is shown in FIGS. 1 to 3 and 17 to 19—or toward the closed position—this version is shown in FIGS. 4 to 6—or is such that it does not produce any pushing force.

In a first advantageous embodiment of the invention, the rocker 5 consists of at least one part of shaped sheet metal 10 to which an insert 9' or 9" made of plastic or other suitable material is anchored; this insert is appropriately shaped, in the part that rests on the spring 8, in the shape of a cam. In this way, different types of cams or cams with different profiles can be fixed to the shaped part 10, allowing the hinge to acquire different functions: for example, using the same spring to produce a pushing force both when closing the door and when opening the door.

Figure 2:
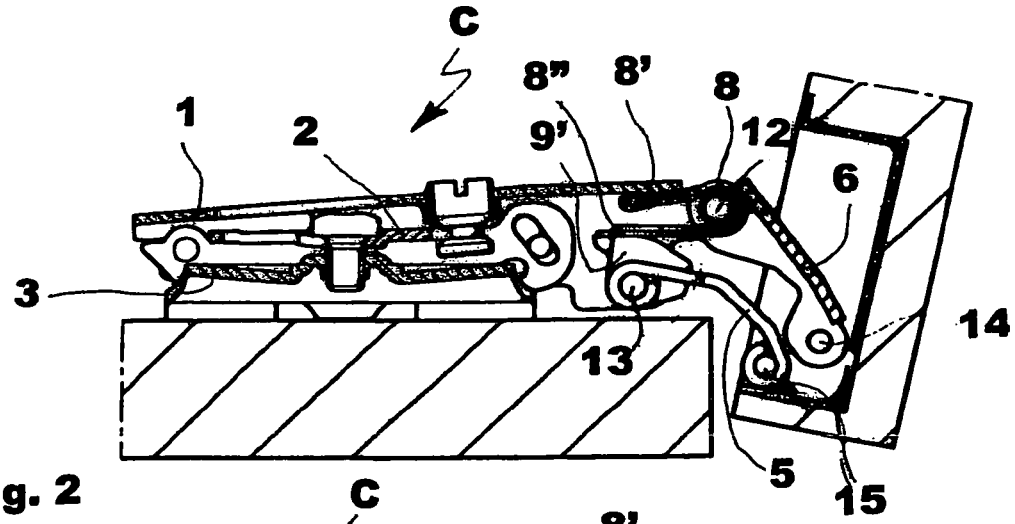
Figure 3:
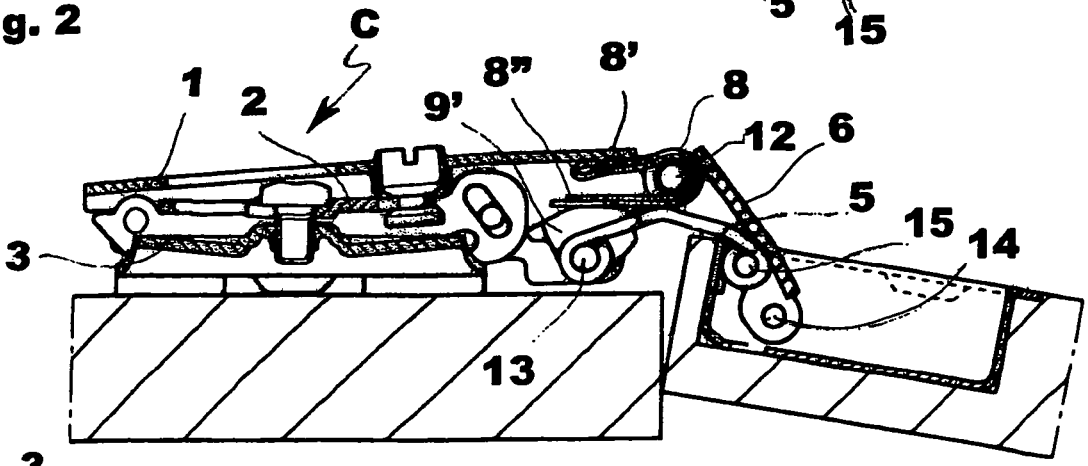

FIGS. 1 to 3 show an embodiment of the rocker 5 wherein the spring produces a pushing force on the door 11 during opening. In this case, the rocker is joined to a cam 9' having such a shape to generate, when an appropriate point of a spring arm 8" is pressed, a pushing force that, for example, suffices to open the door by rotating it clockwise approximately 8°-10° with reference to the figures. The door can be equipped with, for example, some type of retainer. Possible retainers include spring, magnetic, or hook types that keep the door closed. When released from the retainer, the pushing force causes the door to open at an angle predetermined by the profile of the cam 9'. Due to the particular way in which the cam 9' is made, the spring has no effect whatsoever on the remainder of the door-opening rotation.

Figure 4:
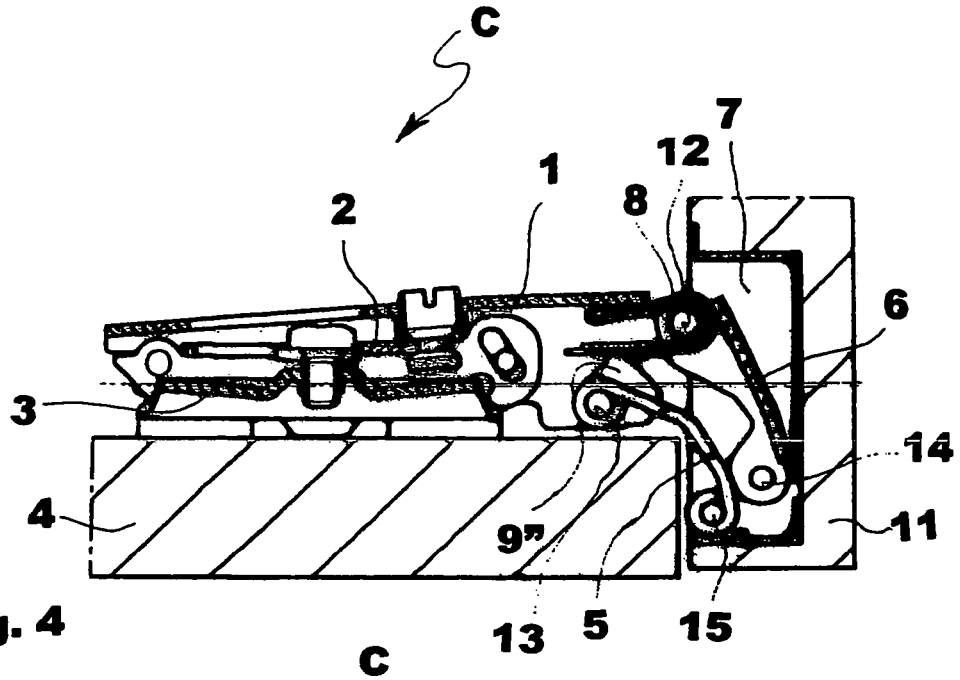
FIGS. 4, 5, 6 show sections of a further embodiment of the hinge in accordance with the invention in three different opening positions of a door of a piece of furniture.
Figure 5:
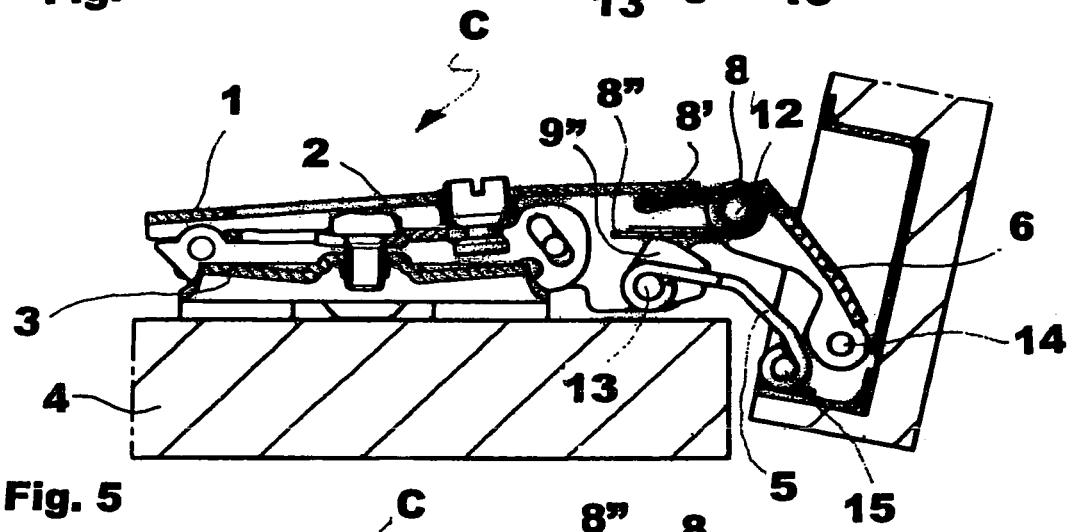
Figure 6:
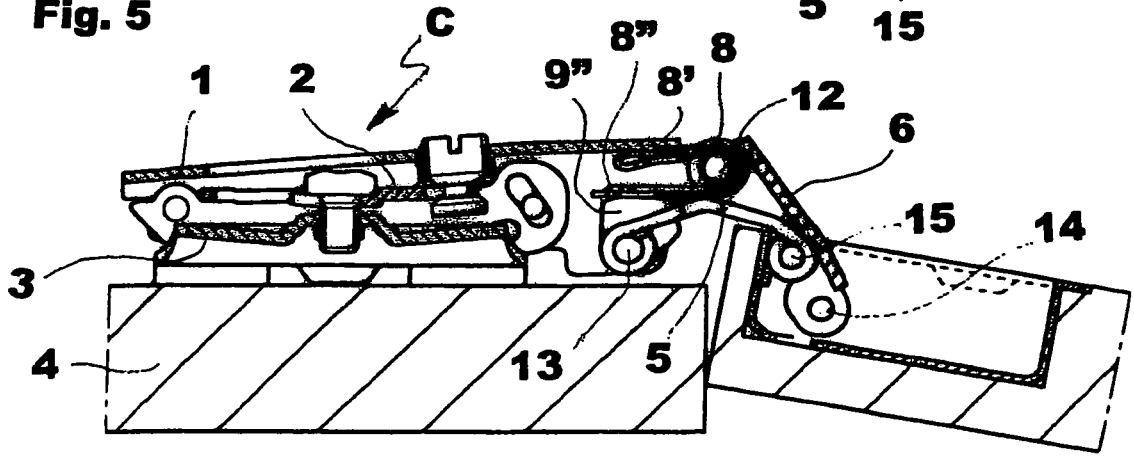
Figure 7:
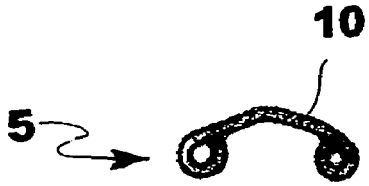
FIG. 7 shows a section of an element of the hinge of the invention.
Figure 8:
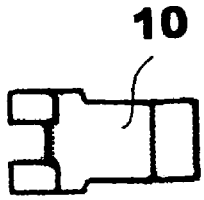
FIG. 8 shows a side view of the element of FIG. 7.
Figure 9:
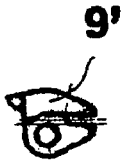
FIG. 9 shows a view of an element of the hinge in accordance with the invention.
Figure 10:
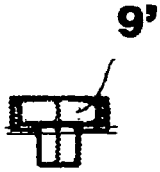
FIG. 10 shows a side view of the element displayed in FIG. 9.
Figure 11:
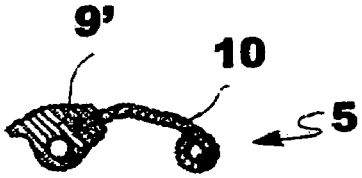
FIG. 11 shows a sectional view of the elements of FIGS. 7 and 9 in the assembled position.
Figure 12:
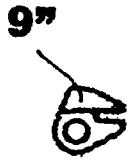
FIG. 12 shows a view of an element of the hinge in accordance with the invention.
Figure 13:
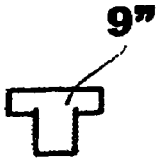
FIG. 13 shows a side view of the element of FIG. 12.
Figure 14:
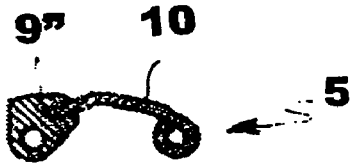
FIG. 14 shows a sectional view of the elements of FIGS. 7 and 12 in the assembled position.

FIGS. 4 to 6 show an embodiment of the hinge providing a profile for cam 9", placed on the rocker 5, that makes the spring 8 to produce a pushing force on the door 11 during closing, counterclockwise with reference to the Figures, starting with a slightly open door at an angle between 15° and 20°. Due to the particular profile of cam 9", the spring has no effect whatsoever on the remainder of the door-opening pivoting.

The different embodiments of the rocker 5, consisting of the shaped part 10 and the cams 9' and 9", are shown in more detail in FIGS. 7 to 14.

Figure 15:
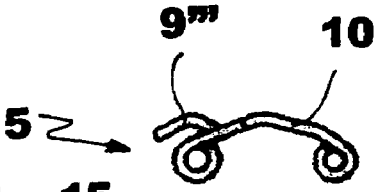
FIG. 15 shows a view of an alternative embodiment of an element of the hinge in accordance with the invention.
Figure 16:
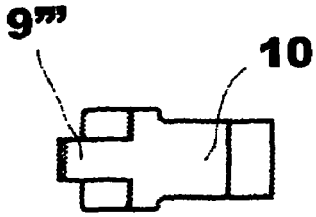
FIG. 16 shows a side view of the element of FIG. 15.
Figure 17:
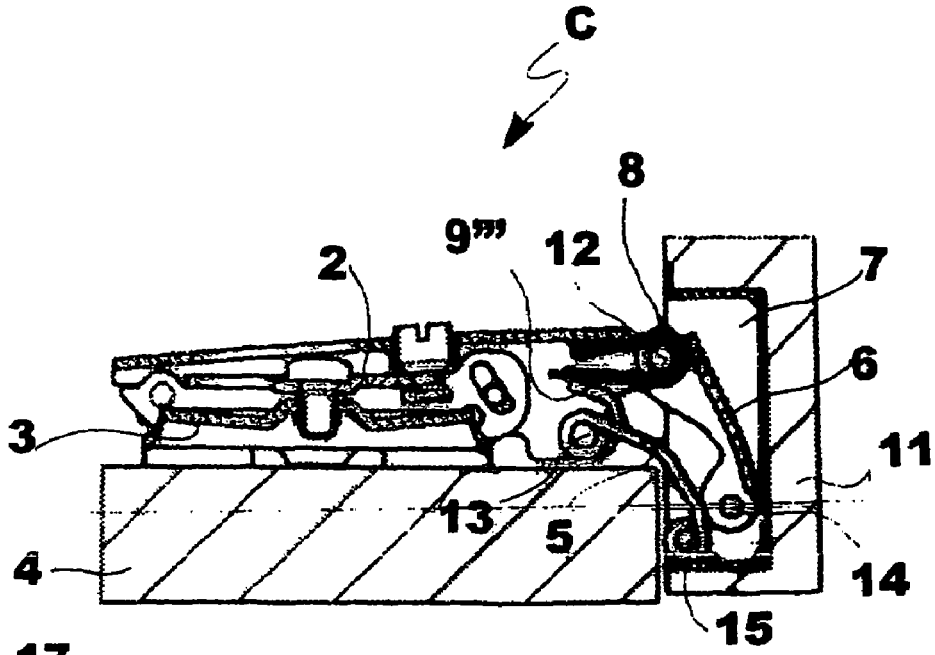
FIGS. 17, 18, 19 show sections of another embodiment of a hinge in accordance with the invention in three different opening positions of a door of a piece of furniture.
Figure 18:
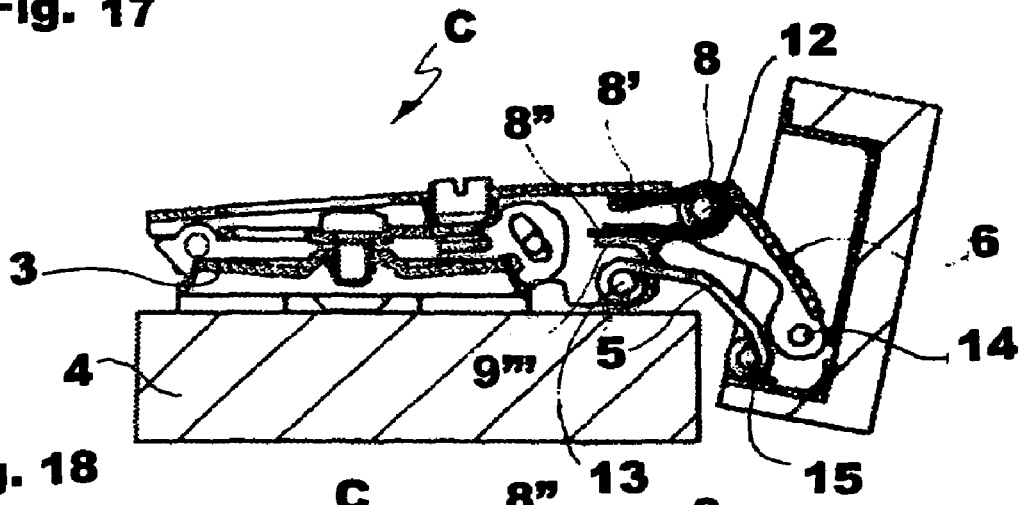
Figure 19:
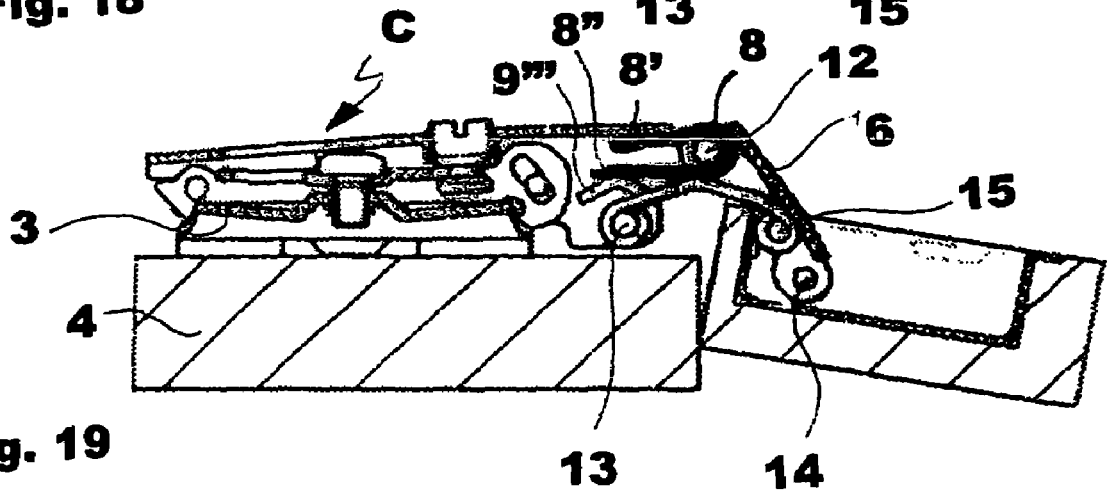

Another embodiment of the hinge in accordance with the invention comprises the rocker 5 shown in FIGS. 15 and 16. The rocker 5 is made in a single piece consisting of shaped sheet metal. Instead of the cam, this version comprises a tongue 9'" that protrudes from the back of the rocker 5. When the hinge is in the assembled position, the tongue 9'" pushes against an arm of the spring 8 and carries out the same functions as the previously discussed cams 9' or 9", depending on the shape of the tongue. In the example shown in FIGS. 17 to 19, the tongue of the rocker is shaped to carry out the same function as the cam 9' shown in FIGS. 1 to 3. The advantage of this version is that it saves time and money thanks to its low production cost and eliminates one assembly step.

The rocker made as described above gives the hinge greater versatility. Its low production cost decreases the cost of the hinges, allowing economies of scale.

The particular embodiments described here do not limit the scope of this patent application, which covers all the embodiments of the invention defined in the claims.

The invention claimed is:

1. A furniture hinge comprising:

a fixing arm for fixing to a piece of furniture, an element for fixing to a door, a first rocker and a second rocker forming a four-bar linkage and connecting the fixing arm to the element so as to enable a reciprocal pivoting, wherein the second rocker is removably insertable into the four-bar linkage, a V-shaped spring having a first arm and a second arm, placed around a pin near an end of the first rocker, wherein the first arm of the spring rests on the fixing arm, and the second arm rests in direct contact on a first cam-shaped protrusion of the second rocker, the first cam-shaped protrusion having a first predefined shape, whereby a lever arm is created adapted to compress the V-shaped spring to apply a first force on the second rocker positioned in the four-bar linkage, with the first force oriented in a first direction selected from the group consisting of a door-closing pivoting direction or a door-opening pivoting direction, wherein the removably insertable second rocker is selected by a user from the group consisting of a first rocker configuration, a second rocker configuration, and a third rocker configuration with differently positioned and shaped cam-shaped protrusions on each rocker configuration, wherein the first rocker configuration includes:

a first shaped member; and a first insert of a first shape anchored to an end of the first shaped member;

wherein the second rocker configuration includes:

second shaped member; and a second insert of a second shape different from the first shape and with the second insert mounted to an end of the second shaped metal member; and wherein the third rocker configuration includes:

a third shaped metal member with a shaped tongue at an end of the third shaped metal member;

whereby, with the second rocker selected by the user and mounted to the fixing arm, a second force is applied on the second rocker, with the second force oriented in a second direction opposite to the first direction.

2. The furniture hinge as claimed in claim 1, wherein each of the first, second, and third rocker configurations of the respectively mounted second rocker compresses the V-shaped spring only for a short segment of said reciprocal pivoting, corresponding to a last portion of the door-closing pivoting.

3. The furniture hinge as claimed in claim 2, wherein each of the first and second inserts of the first and second rocker configurations, respectively, of the respectively mounted second rocker is a plastic cam fixed to the first and second shaped metal member, respectively, and jointly forming the respectively mounted second rocker.

4. The furniture hinge as claimed in claim 1, wherein the tongue of the third rocker configuration is integral to the structure of the third shaped metal member.

5. A furniture hinge comprising:

a fixing arm for fixing to a piece of furniture, an element for fixing to a door, a first rocker and a second rocker forming a four-bar linkage and connecting the fixing arm to the element so as to enable a reciprocal pivoting, wherein the second rocker is removably insertable into the four-bar linkage, a V-shaped spring having a first arm and a second arm, placed around a pin near an end of the first rocker, wherein the first arm of the spring rests on the fixing arm, and the second arm rests in direct contact on a first cam-shaped protrusion of the second rocker, the first cam-shaped protrusion having a first predefined shape, whereby a lever arm is created adapted to compress the V-shaped spring to apply a first force on the second rocker positioned in the four-bar linkage, with the first force oriented in a first direction selected from the group consisting of -a door-closing pivoting direction or a door-opening pivoting direction, wherein the removably insertable second rocker is selected by a user from the group consisting of a first rocker configuration, a second rocker configuration, and a third rocker configuration with differently positioned and shaped cam-shaped protrusions on each rocker configuration, wherein the first rocker configuration includes:

a first shaped member; and a first insert (9') of a first predetermined shape anchored to an end of the first shaped member;

wherein the second rocker configuration includes:

a second shaped member; and a second insert (9") of a second predetermined shape different from the first predetermined shape and with the second insert mounted to an end of the second shaped metal member; and wherein the third rocker configuration includes:

a third shaped metal member with a shaped tongue (9''') extending from an end of the third shaped metal member;

whereby, with the second rocker selected by the user and mounted to the fixing arm, a second force is applied on the second rocker, with the second force oriented in a second direction opposite to the first direction.

6. The furniture hinge as claimed in claim 5, wherein each of the first, second, and third rocker configurations of the respectively mounted second rocker compresses the V-shaped spring only for a short segment of said reciprocal pivoting, corresponding to a last portion of the door-closing pivoting.

7. The furniture hinge as claimed in claim 6, wherein each of the first and second inserts of the first and second rocker configurations, respectively, of the respectively mounted second rocker is a plastic cam fixed to the first and second shaped metal member, respectively, and jointly forming the respectively mounted second rocker.

8. The furniture hinge as claimed in claim 5, wherein the tongue of the third rocker configuration is integral to the structure of the third shaped metal member.

9. A kit for use with a fixing arm for fixing to a piece of furniture, and an element for fixing to a door, the kit comprising:

a first rocker and a second rocker forming a four-bar linkage and connecting the fixing arm to the element so as to enable a reciprocal pivoting, wherein the second rocker is removably insertable into the four-bar linkage, a V-shaped spring having a first arm and a second arm, placed around a pin near an end of the first rocker, wherein the first arm of the spring rests on the fixing arm, and the second arm rests in direct contact on a first cam-shaped protrusion of the second rocker, the first cam-shaped protrusion having a first predefined shape, whereby a lever arm is created adapted to compress the V-shaped spring to apply a first force on the second rocker positioned in the four-bar linkage, with the first force oriented in a first direction selected from the group consisting of a door-closing pivoting direction or a door-opening pivoting direction, wherein the removably insertable second rocker is selected by a user from the group consisting of a first rocker configuration, a second rocker configuration, and a third rocker configuration with differently positioned and shaped cam-shaped protrusions on each rocker configuration;

wherein the first rocker configuration includes:

a first shaped member; and a first insert of a first shape anchored to an end of the first shaped member;

wherein the second rocker configuration includes:

a second shaped member; and second insert of a second shape different from the first shape and with the second insert mounted to an end of the second shaped metal member; and wherein the third rocker configuration includes a third shaped metal member with a shaped tongue at an end of the third shaped metal member;

whereby, with the second rocker selected by the user and mounted to the fixing arm, a second force is applied on the second rocker, with the second force oriented in a second direction opposite to the first direction.

10. The kit as claimed in claim 9, wherein each of the first, second, and third rocker configurations of the respectively mounted second rocker compresses the V-shaped spring only for a short segment of said reciprocal pivoting, corresponding to a last portion of the door-closing pivoting.

11. The kit as claimed in claim 10, wherein each of the first and second inserts of the first and second rocker configurations, respectively, of the respectively mounted second rocker is a plastic cam fixed to the first and second shaped metal member, respectively, and jointly forming the respectively mounted second rocker.

12. The kit as claimed in claim 9, wherein the tongue of the third rocker configuration is integral to the structure of the third shaped metal member.

13. A furniture hinge comprising:

a fixing arm (1) for fixing to a piece of furniture (4), an element (7) for fixing to a door (11), a first rocker (6) and a second rocker (5) connecting the fixing arm (1) to the element (7) for fixing to the door (11) so as to enable a reciprocal pivoting, wherein the second rocker (5) is joined to a specific cam selected from the group consisting of a first cam (9") and a second cam (9'), wherein the first cam (9") and the second cam (9') have different shapes, and a spring (8), placed around a pin (12) of the first rocker (6), wherein a first arm (8') of the spring (8) rests on the fixing arm (1), and a second arm (8") of the spring (8) rests on the selected cam joined to the second rocker (5) whereby a lever arm is created and adapted to produce a moment on the furniture hinge for a limited door pivot angle near a closed position of the door (11), whereby at least one of two configurations is achieved, consisting of the furniture hinge has:

a first configuration of the furniture hinge in which the first cam (9") is joined to the second rocker (5), with the first cam (9") being shaped so that the moment produced by the spring (8), operating with the second rocker (5) joined to the first cam (9"), pushes the door (11) to close, and the second rocker (5) is not joined to the second cam (9'), and a second configuration of the furniture hinge in which the second cam (9') is joined to the second rocker (5), with the second cam (9') being shaped so that the moment produced by the spring (8), operating with the second rocker (5) joined to the second cam (9'). pushes the door (11) to open, and the second rocker (5) is not joined to the first cam (9"), and wherein, with either of the first and second configurations of the furniture hinge, the remaining components of the furniture hinge are are structurally unchanged.

* * * * *